US005548865A

United States Patent [19]

Pagani

[11] Patent Number: 5,548,865

[45] Date of Patent: Aug. 27, 1996

[54] FLOOR CLOTH BUCKET AND WRINGER DEVICE

[75] Inventor: Elio Pagani, Arese, Italy

[73] Assignee: VDM S.r.l., Arese, Italy

[21] Appl. No.: 350,768

[22] Filed: Dec. 7, 1994

[30] Foreign Application Priority Data

Dec. 22, 1993 [IT] Italy ..... MI930988 U

[51] Int. Cl.[6] ..... A47L 13/58

[52] U.S. Cl. ..... 15/262; 15/260; 15/264; 220/23.86; D32/53; D32/54

[58] Field of Search ..... 15/260–264; 220/23.83, 220/23.86, 527; D32/53, 53.1, 54

[56] References Cited

U.S. PATENT DOCUMENTS

| | | | |
|---|---|---|---|
| 668,703 | 2/1901 | Young | 15/261 |
| 1,118,401 | 11/1914 | Denton | 15/262 |
| 1,164,050 | 12/1915 | Zodac | 220/527 |
| 1,388,688 | 8/1921 | Bailhache | 15/262 |
| 1,517,164 | 11/1924 | Lear | 15/264 |
| 2,664,584 | 1/1954 | Twerdahl | 15/264 |
| 3,562,841 | 2/1971 | Royalty | 15/264 |
| 3,589,554 | 6/1971 | Smith | 220/23.83 |
| 4,161,799 | 7/1979 | Sorrells | 15/264 |
| 4,319,761 | 3/1982 | Wells | 15/264 |
| 4,798,307 | 1/1989 | Evrard . | |
| 4,888,847 | 12/1989 | Montijo | 15/263 |
| 5,333,353 | 8/1994 | Taylor | 15/264 |

FOREIGN PATENT DOCUMENTS

| | | |
|---|---|---|
| 3225734 | 1/1984 | Germany . |
| 8914140 | 4/1990 | Germany . |
| 9402339 | 8/1994 | Germany . |
| 467059 | 1/1969 | Switzerland . |
| 120460 | 11/1917 | United Kingdom . |
| 161854 | 5/1920 | United Kingdom . |
| 0906433 | 9/1962 | United Kingdom . |
| 0941920 | 11/1963 | United Kingdom . |
| 1277932 | 6/1972 | United Kingdom . |
| 1520839 | 8/1978 | United Kingdom . |

*Primary Examiner*—Mark Spisich
*Attorney, Agent, or Firm*—Guido Modiano; Albert Josif

[57] ABSTRACT

Device for collecting dirty washing liquid and for containing liquid for wetting a floor-cloth or the like, for washing floors or the like by hand, including a main container, which supports a wringer and forms a compartment for collecting the liquid produced by wringing the floor-cloth used for washing. The device also comprises a secondary container, which is connected to the main container and is suitable to contain a liquid for wetting the floor-cloth.

2 Claims, 1 Drawing Sheet

FLOOR CLOTH BUCKET AND WRINGER DEVICE

BACKGROUND OF THE INVENTION

The present invention relates to a device for collecting dirty washing liquid and for containing liquid for wetting a floor-cloth or the like, particularly for washing floors or the like by hand.

As is known, floors or the like are generally washed by hand with a floor-cloth that is wet with a washing liquid, which can be either just water or water with the addition of a detergent; the floor-cloth is repeatedly passed over the floor and then washed and wrung before being passed over the floor again.

Appropriate devices are currently used to wet the floor-cloth and to collect the liquid and dirt produced by wringing the floor-cloth; these devices are usually constituted by a wheeled trolley which carries a bucket that contains the liquid used to wet the floor-cloth and another bucket which is placed below a wringer which is supported by said trolley and contains the dirty liquid produced by wringing the floor-cloth after wetting it.

Other devices are also known which have considerably modest dimensions with respect to these trolleys and are therefore practical to use even in confined spaces.

These devices are simply constituted by a bucket of adequate size which is provided with castors, so as to make it easy to move it over the floor to be cleaned, and supports a wringer. In practice, in these devices the bucket in which the dirty liquid produced by wringing the floor-cloth is collected is also the structure for supporting and carrying the wringer.

Although this type of device has undeniable advantages with respect to trolley-like devices, particularly as regards maneuverability and practicality in use, it has some drawbacks as regards the results obtainable in washing floors. With this device the floor-cloth must in fact be wet, before wringing it, in the liquid collected inside the bucket, that is to say in the dirty liquid resulting from previous wringings. Due to this fact, dirt accumulates in the liquid during washing, and this accumulation gradually reduces the effectiveness of the washing action since part of the previously collected dirt is deposited back onto the floor together with the dirty water used to wet the floor-cloth.

SUMMARY OF THE INVENTION

A principal aim of the present invention is to obviate the above described drawbacks by providing a device for collecting dirty washing liquid and for containing liquid for wetting a floor-cloth or the like, particularly for washing floors or the like by hand, which is extremely maneuverable and allows to achieve good cleaning results.

Within the scope of this aim, an object of the invention is to provide a device that can be used without problems even in confined spaces.

Another object of the invention is to provide a device having production costs that can be compared with those of current devices used to wash floors by hand.

This aim, these objects, and others which will become apparent hereinafter are achieved by a device for collecting dirty washing liquid and for containing liquid for wetting a floor-cloth or the like, particularly for washing floors or the like by hand, characterized in that it comprises a main container, which supports a wringer and forms a compartment for collecting the liquid produced by wringing the floor-cloth used for washing, and a secondary container, which is connected to said main container and is suitable to contain a liquid for wetting the floor-cloth.

BRIEF DESCRIPTION OF THE DRAWINGS

Further characteristics and advantages will become apparent from the following detailed description of the device according to the invention, illustrated only by way of non-limitative example in the accompanying drawings, wherein.

DESCRIPTION OF THE PREFERRED EMBODIMENTS

Figure 2:
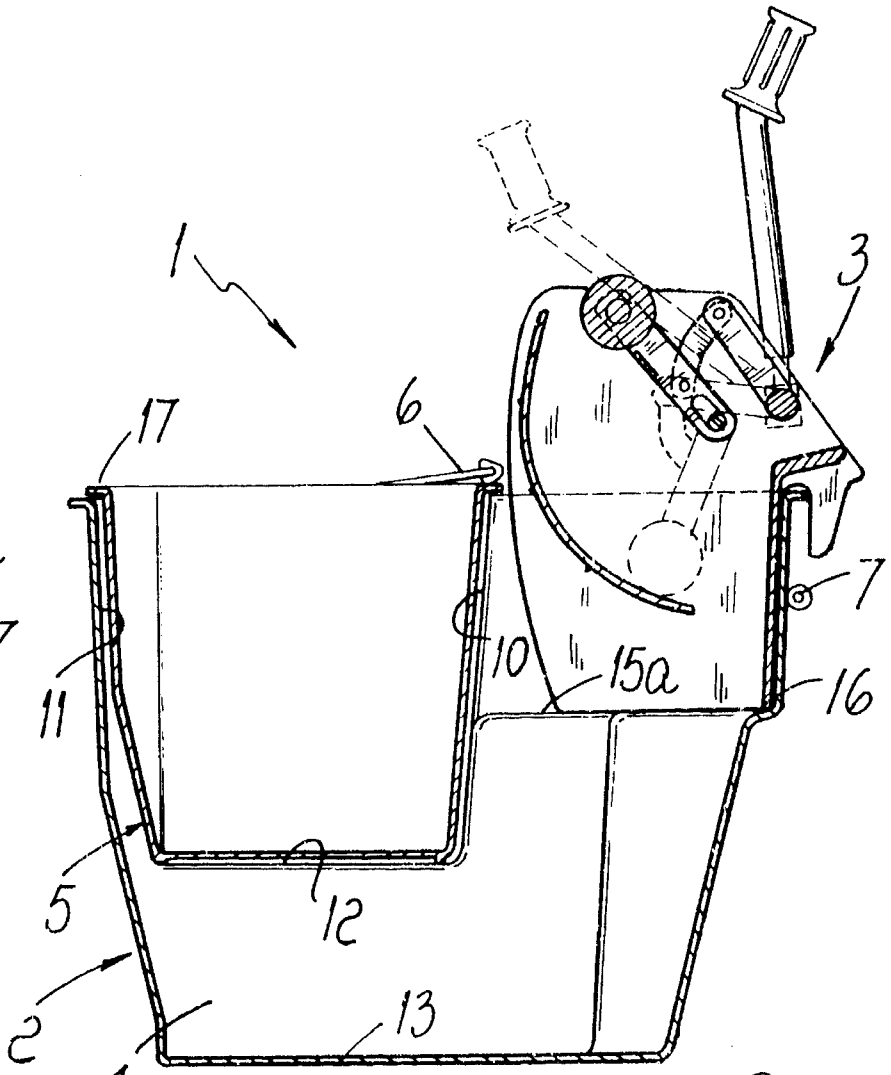
FIG. 2 is a vertical sectional view of the device according to the invention.
Figure 1:
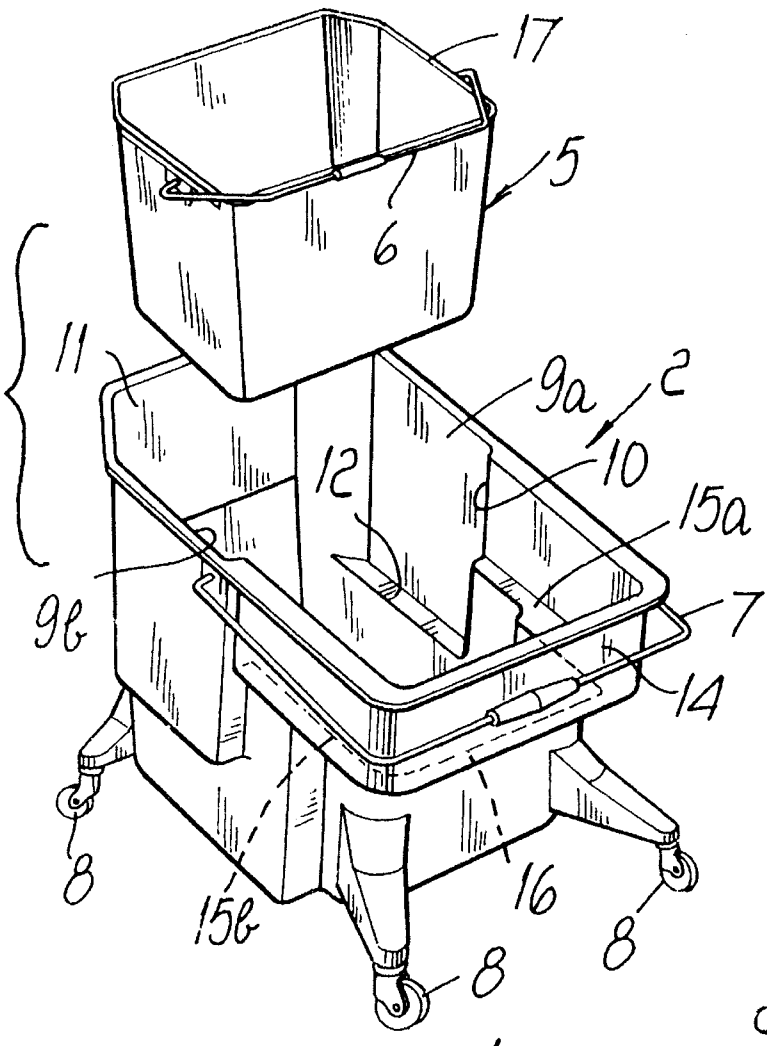
FIG. 1 is an exploded perspective view of the main container and of the secondary container.

With reference to the above figures, the device according to the invention, generally designated by the reference numeral 1, comprises a main container or bucket 2 which supports a known type of wringer 3 and forms, below the wringer 3, a collection compartment 4 for the dirty washing liquid produced by wringing the floor-cloth used to wash floors or the like.

The device furthermore comprises a secondary container or bucket 5 which is located inside the main container 2 for containing a liquid for wetting the floor-cloth, such as for example water or water with detergent.

Conveniently, the secondary container 5 is detachably associated with the main container 2 and has a handle 6 so that it can be easily removed from the main container 2 for filling or emptying it.

The main container 2 is also conveniently provided with a handle 7 and has castors 8 that allow to easily move the device over the floor during washing.

Seats 9*a* and 9*b* are formed on two opposite side walls of the main container 2 to detachably accommodate the secondary container 5 inside the main container 2. Said seats form lateral shoulders 10, which keep the secondary container close to the front wall 11 of the main container 2, and lower shoulders 12, on which the secondary container 5 rests; said lower shoulders keep the secondary container 5 spaced from the bottom 13 of the main container 2, so that an adequate volume is provided below the secondary container 5 to contain the liquid produced by wringing the floor-cloth with the wringer 3.

The wringer 3 is mounted on the main container 2 at its rear wall 14, and raised portions 15*a*, 15*b*, and 16 for the wringer 3 are provided on the side walls of the main container 2, proximate to the rear wall 14, and on said rear wall 14, so as to adequately support the wringer during use.

These supporting raised portions 15*a*, 15*b*, and 16 are formed by a reduction of the width of the main container 2 towards its bottom and also have the effect of stiffening the structure of the main container 2 proximate to the rear wall 14 to which the wringer 3 is applied, so as to assuredly avoid deformation of the main container 2 during use of the wringer 3.

The secondary container 5 conveniently has, at its mouth, a protruding perimetric rim 17 which is meant to rest on the perimetric rim of the mouth of the main container 2, so as to assist the supporting action of the lower shoulders 12.

The main container 2 and the secondary container 5 are both conveniently made of molded synthetic material.

The operation of the device according to the invention is as follows.

When floor washing begins, the main container 2 is empty and the clean washing liquid, optionally with the addition of a detergent, is present in the secondary container 5.

The floor is washed by wetting the floor-cloth inside the secondary container 5 and by then passing the floor-cloth through the wringer 3, so as to remove the excess liquid before passing it over the floor.

After passing it over the floor, the floor-cloth is dipped again in the secondary container 5 and is then passed through the wringer 3, which removes not only the excess liquid but also the dirt removed from the floor by the floor-cloth.

The liquid produced by wringing the floor-cloth collects on the bottom of the main container 2, and floor washing continues are already described.

In practice it has been observed that the device according to the invention fully achieves the intended aim, because its bulk is comparable to that of devices which are simply constituted by a bucket and a wringer, making it highly maneuverable even in confined spaces, and because it provides improved cleaning owing to the fact that the liquid used to wet the floor-cloth is kept separate from the liquid produced by wringing the floor-cloth.

The device according to the invention can be supplied complete with the wringer or can be supplied without the wringer and use an existing wringer.

In practice, the materials employed, as well as the dimensions, may be any according to the requirements and the state of the art.

What is claimed is:

1. Device for collecting dirty washing liquid and for containing liquid for wetting a floor-cloth, for washing floors by hand, wherein said device comprises a main container, which supports a wringer and forms a compartment for collecting liquid produced by wringing a floor-cloth used for washing, and a secondary container, connected to said main container for containing liquid for wetting a floor-cloth, wherein said main container has a bottom, a front wall, a rear wall, two opposite side walls extending between said front wall and said rear wall and an interior portion, and wherein said main container has raised portions, in the interior portion of said main container between top and bottom portions thereof, for supporting the wringer on said rear wall and on said two opposite side walls proximate to said rear wall.

2. Device according to claim 1, wherein said raised portions for supporting the wringer are formed by a reduction in the width of said main container towards said bottom.

* * * * *